US009101192B2

(12) United States Patent
Martins et al.

(10) Patent No.: US 9,101,192 B2
(45) Date of Patent: Aug. 11, 2015

(54) REFILL-LOCKING SYSTEM, A PACKAGE COMPRISING SAID LOCKING SYSTEM, AND A REFILL

(75) Inventors: Paula Renata Martins, Vila Madalena (BR); Fabiana Tomas Pelliciari, Jundiai (BR); Fernanda Marra, Vila Mariana (BR)

(73) Assignee: Natura Cosmeticos S.A., Sao Paulo (BR)

( * ) Notice: Subject to any disclaimer, the term of this patent is extended or adjusted under 35 U.S.C. 154(b) by 14 days.

(21) Appl. No.: 12/090,502

(22) PCT Filed: Oct. 20, 2006

(86) PCT No.: PCT/BR2006/000221

§ 371 (c)(1),
(2), (4) Date: May 29, 2008

(87) PCT Pub. No.: WO2007/045061

PCT Pub. Date: Apr. 26, 2007

(65) Prior Publication Data

US 2008/0230436 A1 Sep. 25, 2008

(30) Foreign Application Priority Data

Oct. 21, 2005 (BR) ..... PI0504830

(51) Int. Cl.
*B65D 69/00* (2006.01)
*A45D 33/00* (2006.01)

(52) U.S. Cl.
CPC ..... *A45D 33/006* (2013.01)

(58) Field of Classification Search
CPC ..... A45C 11/008; A45D 40/22; A45D 33/006
USPC ..... 206/581, 385, 823, 477, 482, 487, 235, 206/81, 1.7–1.9; 132/293–295, 299, 303, 132/314, 315, 298, 301, 286, 296, 297, 300, 132/302, 304, 305, 306, 307, 316, 317, 132/318; 220/838; 424/401; 506/581, 823
See application file for complete search history.

(56) References Cited

U.S. PATENT DOCUMENTS 1,438,835 A * 12/1922 Kendall ..... 132/294
1,647,917 A * 11/1927 Kendall ..... 132/293

(Continued)

FOREIGN PATENT DOCUMENTS

DE 42 03 260 8/1993
EP 0 733 318 9/1996

(Continued)

OTHER PUBLICATIONS

International Search Report for PCT Application No. PCT/BR2006/000221; Date of Filing Oct. 20, 2006; Date of Completion Feb. 14, 2007; Date of Mailing Feb. 26, 2007.

(Continued)

*Primary Examiner* — Jacob K Ackun
*Assistant Examiner* — Jenine Pagan
(74) *Attorney, Agent, or Firm* — Alston & Bird LLP

(57) ABSTRACT

The present invention relates to a locking system designed for packages intended particularly for packing make-up comprising refills without the use of adhesives. The locking system for packages comprises:—a base (1) having a side wall (11);—a cover (3) cooperating with the base (1);—a refill (2) composed by at least one first cavity (4); said locking system being characterized in that:—the refill (2) comprises at least one first securing means (21) in the form of a side projection facing outwardly and a second securing means (22) in the form of a side projection facing outwardly and having a curved end;—the first securing means (21) being opposed to the second securing means (22);—the side wall (11) having at least one first opening (12) cooperating with the first securing means (21) and a second opening (13) cooperating with the second securing means (22);—the refill (2) being fitted into the base (1) by association between the first securing means (21) and the first opening (12) and then association between the second securing means (22) and the second opening (13). The present invention further relates to packages comprising said locking system and the refill comprised in this system.

2 Claims, 2 Drawing Sheets

(56) References Cited

U.S. PATENT DOCUMENTS

| | | | | | |
|---|---|---|---|---|---|
| 1,774,543 | A | * | 9/1930 | Babbitt | 220/326 |
| 4,162,010 | A | * | 7/1979 | Hovsepian | 206/229 |
| 4,369,799 | A | * | 1/1983 | Napoleon | 132/294 |
| 4,595,028 | A | * | 6/1986 | Yuhara | 132/314 |
| 4,681,127 | A | * | 7/1987 | Gueret | 132/301 |
| 4,774,973 | A | * | 10/1988 | Gueret | 220/326 |
| 4,863,034 | A | * | 9/1989 | Contreras, Sr. | 206/581 |
| 4,930,528 | A | * | 6/1990 | Hatakeyama | 132/301 |
| 4,982,751 | A | * | 1/1991 | Oishi et al. | 132/299 |
| 5,005,697 | A | * | 4/1991 | Jimbo et al. | 206/235 |
| 5,161,556 | A | * | 11/1992 | Audebourg et al. | 132/296 |
| 5,199,451 | A | * | 4/1993 | Montoli | 132/315 |
| 5,211,302 | A | * | 5/1993 | Tiramani | 220/4.25 |
| 5,331,982 | A | * | 7/1994 | Machelett | 132/301 |
| 5,353,818 | A | * | 10/1994 | Suzuki et al. | 132/300 |
| 5,713,471 | A | * | 2/1998 | Gueret | 206/581 |
| 5,931,169 | A | | 8/1999 | Kervoalen | |
| 5,950,639 | A | * | 9/1999 | Suzuki et al. | 132/294 |
| D426,029 | S | * | 5/2000 | Lai | D28/82 |
| 6,076,679 | A | * | 6/2000 | Yuhara et al. | 206/581 |
| 6,138,686 | A | * | 10/2000 | Yuhara | 132/294 |
| 6,149,008 | A | * | 11/2000 | Yuhara | 206/581 |
| 6,354,308 | B1 | * | 3/2002 | Kuk | 132/301 |
| 6,886,695 | B1 | * | 5/2005 | Karoly | 206/581 |
| 2002/0179485 | A1 | * | 12/2002 | Shih | 206/581 |
| 2003/0183240 | A1 | * | 10/2003 | Manougian et al. | 132/295 |
| 2003/0213723 | A1 | * | 11/2003 | Lombardi | 206/581 |
| 2004/0170656 | A1 | | 9/2004 | Petit | |
| 2004/0173498 | A1 | * | 9/2004 | Lee | 206/581 |
| 2005/0011806 | A1 | * | 1/2005 | Byun | 206/581 |
| 2005/0115863 | A1 | * | 6/2005 | Yuhara | 206/581 |
| 2005/0205569 | A1 | * | 9/2005 | Kobayashi et al. | 220/4.01 |
| 2007/0187284 | A1 | * | 8/2007 | Goto et al. | 206/581 |
| 2008/0011320 | A1 | * | 1/2008 | Bouix et al. | 132/293 |

FOREIGN PATENT DOCUMENTS

| | | |
|---|---|---|
| FR | 2 686 784 | 8/1993 |
| FR | 2 825 593 | 12/2002 |
| JP | 08 131241 | 5/1996 |
| JP | 9 065920 | 3/1997 |
| JP | 2001 314227 | 11/2001 |
| WO | WO 2004/017788 | 3/2004 |

OTHER PUBLICATIONS

Written Opinion for PCT Application No. PCT/BR2006/000221; Date of Filing Oct. 20, 2006; Date of Completion Feb. 14, 2007; Date of Mailing Feb. 26, 2007.
Response to Written Opinion dated May 8, 2007.
International Preliminary Examination Report on Patentability.

* cited by examiner

REFILL-LOCKING SYSTEM, A PACKAGE COMPRISING SAID LOCKING SYSTEM, AND A REFILL

FIELD OF THE INVENTION

The present invention relates to a locking system for packages particularly for make-up and other cosmetics that comprise refills without using adhesives.

The present invention further relates to packages that comprise said locking system and to a refill.

DESCRIPTION OF THE PRIOR ART

Flasks for cosmetic products such as powdered makeup products are known, wherein the flask comprises a container formed by a base to which a cover secured by a hinge or the like is applied. For the purpose of making this product cheaper for the consumer, there are on the market refills of these make-ups constituted by small trays that are positioned at the base and secured by means of adhesives.

An evident problem encountered with flasks of this type is that the make-up present in the refill is damaged when it is put into the package, and the refill may detach from the base due to the poor arrangement of the adhesive. In order to prevent this problem, it would be advantageous to dispense with the adhesive and to improve the refills.

Some relevant prior-art documents related to the matter of the present invention are cited hereinafter.

Document BR7800850-6 describes a case for make-up products that comprises a base with an articulated cover, the base body being provided with a number of cavities for receiving various make-up products: shades, shade applicators, blushes, blush brushes, compact powder and sponge, base, corrective, rimmel, eyeliner or pencil and lipstick, or combinations of make-ups of various types and colors. Such make-ups may be of a fixed or fitting type, in the latter case in the form of refills for replacement. One does not describe how to fit or fix them.

Document BR9903088-8 discloses a make-up case constituted by a base having a shallow and wide cut-out, which is designed to provide a solution allowing the case to remain open and with the cover folded downwards, so that the color of the make-up paste will be exposed and the cover will be normally used for closing the case and keep it. The use of refills is not foreseen.

French document FR 2825593 discloses a refill of a cosmetic product in the form of compact powder, to be incorporated into a base. The refill comprises reversible and irreversible securing means that cooperate with the securing means of the base.

Document DE 4203260 describes a case that can receive a refill in the form of a compact-powder tray. A platform may be fitted onto the case.

Document WO 2004/17788 describes a cosmetic case that has an opening for a refill container with adhesive structure.

Document US 2003213723 discloses a compact powder the package of which has an opening where the internal container can move. This container can be replaced by a refill.

Document U.S. Pat. No. 5,931,169 discloses a make-up powder case that includes a base and a tray. The base can receive a detachable product refill.

Document JP 9065920 describes a make-up product that can receive a refill. It is presented with a configuration where the case comprises two compartments and the structure prevents refills from overlapping each other.

Therefore, in view of the prior-art documents presented above, no teaching proposes advantages relating to the use of refills for packages, particularly make-up cases, wherein it is not necessary to use adhesives for securing the refills to the package, and still referring to the possibility of using refills of different configurations in the same package.

OBJECTIVES OF THE INVENTION

The present invention has the objective of solving the problems encountered in refills for packages, particularly make-up cases, so as to dispense with the use of adhesives to secure the refills to the package, prevent damage to the make-up contained in the refill trays, facilitate the handling thereof and still referring to the possibility of using refills with different configurations in the same package.

BRIEF DESCRIPTION OF THE INVENTION

The present invention has the objective of providing a locking system indicated particularly for packages such as make-up cases comprising:

- a base that has a side wall;
- a cover cooperating with the base;
- a refill having a longitudinal area smaller than or equal to the longitudinal area of the base;
- the refill comprising at least one first securing means in the form of a side projection facing outwardly and a second securing means in the form of a side projection facing outwardly and having a curved end;
- the first securing means being opposite the second securing means;
- the side wall having at least one first opening cooperating with the first securing means and a second opening cooperating with the second securing means;
- the refill being fitted to the base by association between the first securing means and the first opening and subsequent association between the second securing means and the second opening.

Another objective of the invention is to provide a package comprising the above-described locking system and a refill.

BRIEF DESCRIPTION OF THE FIGURES

The present invention will now be described in greater detail with reference to an embodiment represented in the drawings. The figures show.

DETAILED DESCRIPTION OF THE INVENTION

Figure 1:
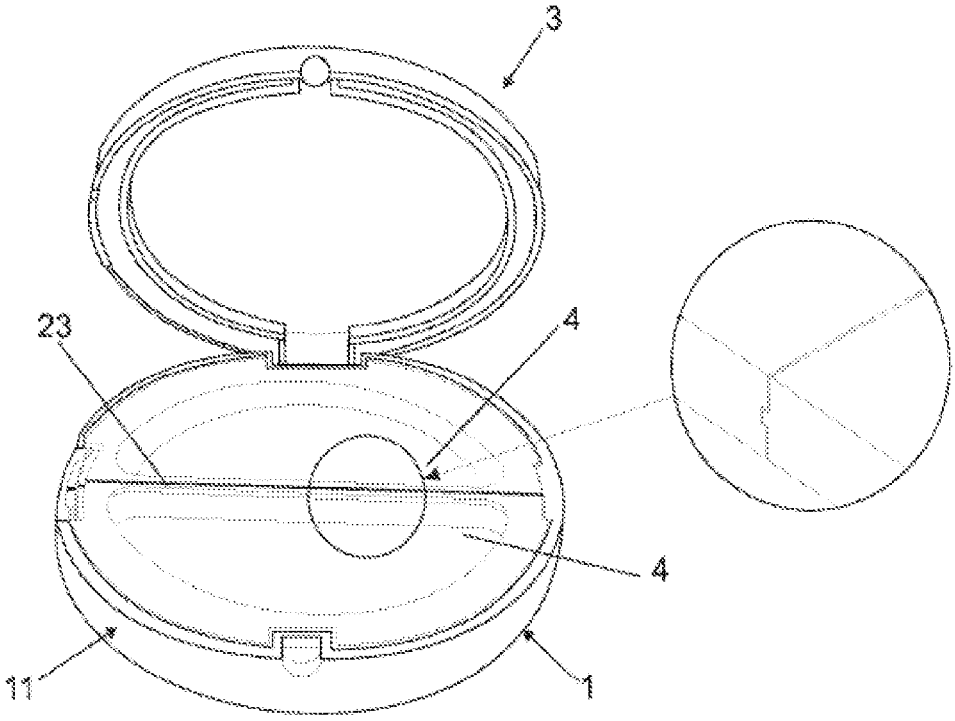
FIG. 1 is a perspective view of an embodiment of the opened package, containing a refill.

The present invention describes a locking system, particularly designed for packages that comprise refills 2 fittable into a base 1 for the case where there is a need for a quite effective locking, securing the refill 2 without damaging the make-up.

The system comprises a base 1 with a side wall 11, a cover 3 cooperating with the base 1 and a refill 2 having a cavity 4 that has a base area smaller than or equal to the base 1 area and is provided with projections 21, 22. Thus, when the package is assembled, the projections 21, 22 present on the refill 2 fit into openings 12, 13 present in the side wall 11 of the base 1.

The main examples of products that may be packed in the package of the present invention are:

- powdered make-up like: compact powder; shade; blush; block lipstick; brightener; base;
- creamy make-up;
- powdered pharmaceutical products;
- powdered cosmetic products;
- other products having a creamy consistence or as compact powder.

The package and the locking system of the present invention have a range of advantages and characteristics desired in products of this kind, some of which are listed below:

- there is no need to secure the refill to the base with the aid of adhesives;
- the refill may be manufactured from the same material used for making the package;
- a number of trays associated laterally can compose the refill to be packed in the base;
- the package of the present invention may receive a single refill comprising a number of compartments or cavities intended for different products;
- the package may comprise a refill on the base and other accessories, such as a mirror, in the inner part of the cover;
- the way of fitting the refill into the base is quite simple, requiring only simplified movements of the user and preventing damages to the make-up packed in the refill at the moment of fitting it;
- the package of the present invention has a strong commercial and marketing appeal due to its modern-day look;
- one can fit the refill into the package of the present invention by using one hand alone;
- the package can receive refill of various types of make-up;
- the lacking system comprises elements that interact by interference, having high efficacy when assembling the package and preventing incidental spillage of the packed product;
- the base and the refill comprised in the package may have varied shapes; thus, the possibilities of shaping and combining these parts are many, providing different models, so as to satisfy all the tastes of the users; and
- the possibility of using a refill brings about reduction of the final cost to the consumer, besides being ecologically correct.

Package

Figure 2:
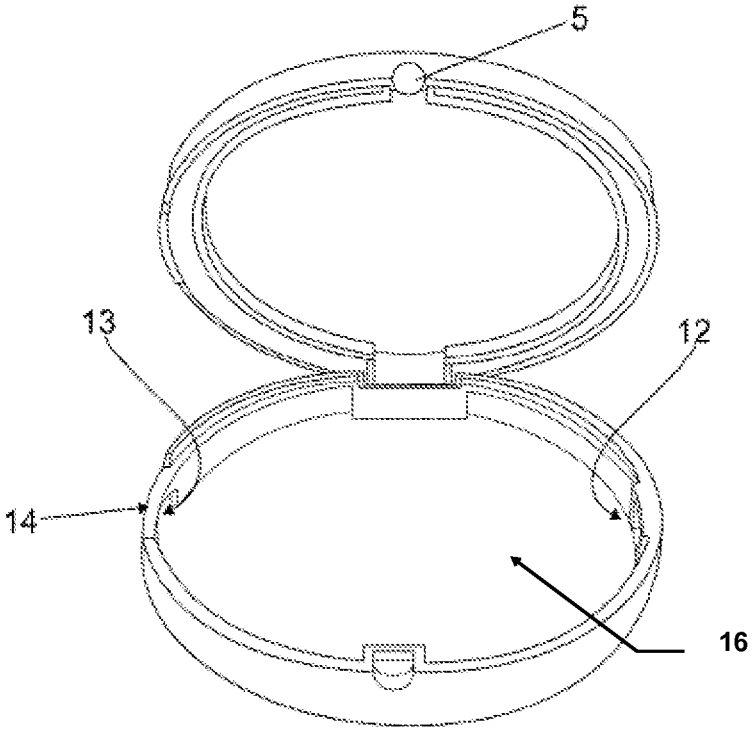
FIG. 2 is a perspective view of an embodiment of the opened package without refill.
Figure 3:
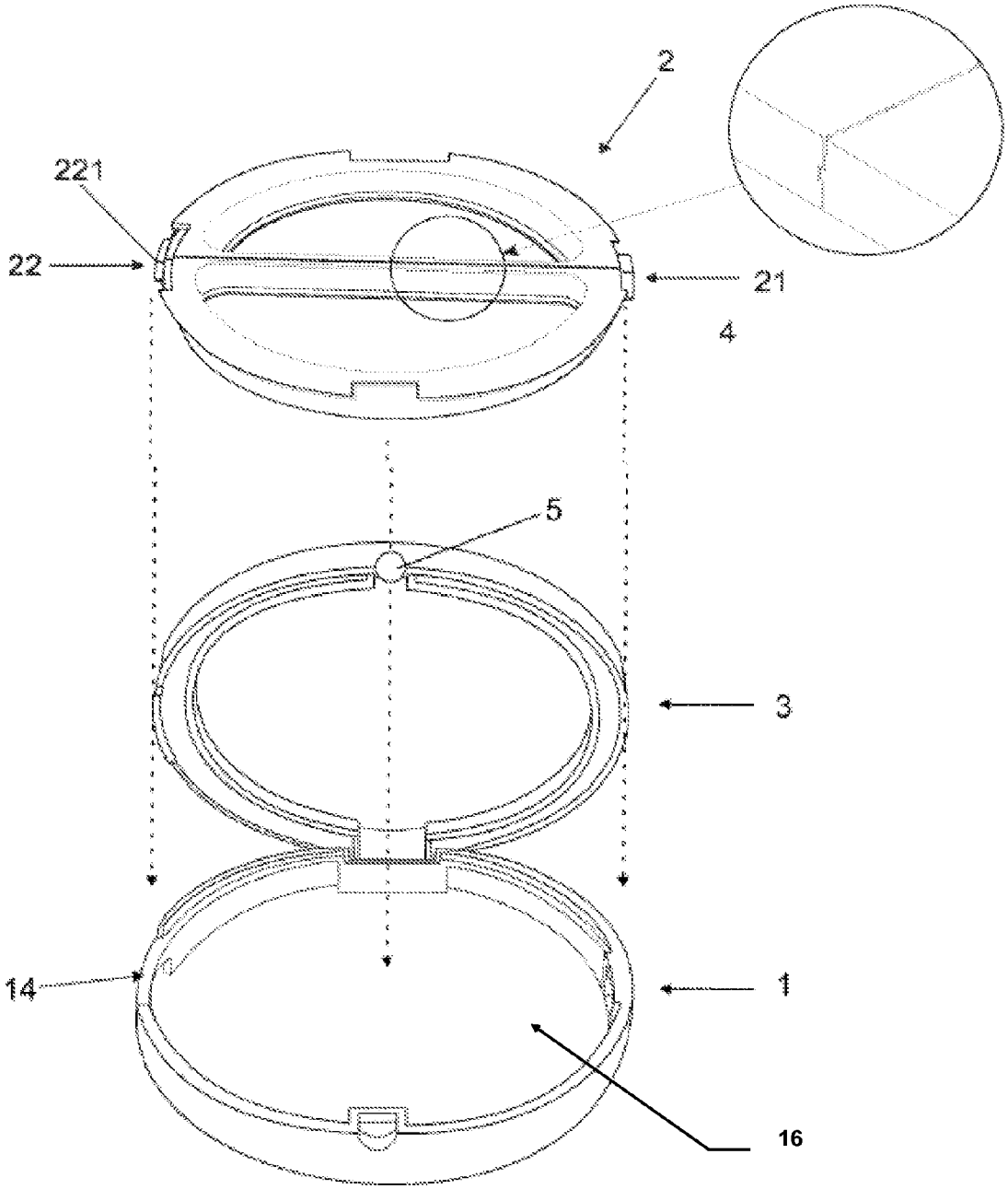
FIG. 3 is a perspective exploded view representing the fitting of the refill into the package of the present invention.

The package of the present invention is constituted by at least one base 1, a refill 2 and a cover 3, as illustrated in FIGS. 1, 2, and 3. All these components may be constituted preferably by plastic material.

Further, the base 1 and the cover 3 cooperate with each other. Preferably, the cover 3 is fixed to the base 1 by means of a hinge that may be external or internal.

Base 1

The base 1 comprises a side wall 11 and a lower portion 16. The side wall 11 follows all the perimeter of the lower portion 16, having a height substantially smaller than its length. By preference the lower portion 16 is oval in shape, as can be seen in FIGS. 1 to 3. Alternatively, the lower portion 16 may have other shapes, for example triangular, quadrangular, among others.

The side wall 11 comprises at least one first and one second openings 12, 13 arranged opposite each other. Through these openings 12, 13 one can secure the refill 2, which will be described later. These openings are located in the inner surface of the side wall 11 and the first opening 12 is at a height relative to the lower portion 16 lower than the height where the second opening 13 is.

The side wall 11 may further comprise other openings, as will be explained later.

Cover

The cover 3 has a shape harmonious with the shape of the base. As shown in FIG. 1, a preferred embodiment comprises said base 1 and the cover 3 in oval shape. Alternatively, other shapes may be chosen.

Further, the cover 3 may comprise a puller 5, as illustrated in the accompanying figures. In addition, the cover 3 may comprise a mirror or other accessory fixed thereto.

Refill

The refill 2 may be understood as a tray that receives make-up, cosmetics, pharmaceutical products, among other possibilities, for attachment to the package to replace a product that has already been used up. The refill 2 comprises at least one cavity 4, where the product is added and still at least two securing means 21 and 22. In addition, the refill 2 may have a shape harmonious with the shape of the base 2, being located in its proximity, without causing difficulties in the association between the base I and the cover 3.

The first securing means 21 is a projection located at the perimeter of the cavity 4 facing outwardly. This projection may be L-shaped. Further, the second securing means 22 is a projection also located at the perimeter of the cavity 4 facing outwardly, being opposed to the first securing means. This projection comprises a curved end and may further have at least one lock at this end, which will fit into the second opening 13 by interference. Further, the end of the second securing means 22 is at a height greater than the height of the end of the first securing means 21, these heights being relative to the cavity 4. The second securing means 22 may be U-shaped.

The first and second securing means 21 and 22 cooperate with the first and second openings 12 and 13 located in the side wall 11.

The second securing means 22 may further have an auxiliary projection 221, located at its end facing outwardly, so as to facilitate the user taking the refill 2 out of the base 1. In this case, the base 1 may comprise a recess 14, where the auxiliary projection 221 will rest upon fitting the refill 2 into the base 1.

The refill 2 may further comprise more securing means besides the described ones. Consequently, the side wall 11 should comprise an equal number of openings in order to enable one to secure the refill 2 to the base 1.

With the presence of the pairs, first securing means 21/first opening 12 and second securing means 22/second opening 13, one can dispense with the use of adhesives, since an optimized way of securing the refill 2 to the base 1 is achieved.

In addition, the refill 2 may comprise a flap located substantially along its whole length, for the purpose of promoting contact of the refill 2 with the side wall 11, thus guaranteeing an improved appearance.

The refill 2 may further comprise more than one cavity 4. As shown in FIG. 3, the refill 2 may be composed of two identical cavities separated by a central wall 23, dividing the refill 2 exactly in the middle. Alternatively, the cavities may be different. The size of the cavities and their arrangement will depend on the products to be packed.

As another option, the refill 2 may be constituted by more than one cavity 4, separated as trays (not shown). In this case, the trays should comprise auxiliary securing means, which may be of the tongue-and-groove type or another known association (see generally FIGS. 1 and 3), so as to be associated to each other, forming the refill 2 to be secured to the base 1. Evidently, said trays should also comprise at least the first and second securing means 21 and 22 for securing the refill 2 to the base 1 when they are associated to each other.

The refill 2 and/or the trays that can constitute it may be covered by a plastic or metallic film, so as to protect the packed product until it is used by the consumer.

Locking—Assembling the Package with a Refill

The main assembly is constituted by the base 1 associated to the cover 3, preferably with the use of a hinge. In this way, the package can be opened or closed. Further, the cover 3 has a puller 5 opposite the point of association of the cover 3 with the base 1.

According to the preferred embodiment illustrated in FIGS. 1 to 3, the base 1 comprises a first opening 12 opposite the second opening 13 and symmetrically spaced from the puller 5 and from the point of association between the cover 3 and the base 1, achieved with the hinge. The second opening 13 is located in the upper portion of the side wall 1. The first opening 12 is located in a lower portion of the side wall 1.

The refill 2 is constituted by two identical cavities 4, separated by a central wall 23 positioned in the center of the refill 2 and still by the first securing means 21 and second securing means 22, opposite each other, located at the side wall 11 when the refill 2 is in place. The central wall 23 extends from the first securing means 21 to the second securing means 22. The first securing means 21 faces outwardly in an "L" shape, its end being located at a lower portion of the side wall 11 when the refill 2 is in place. The second securing means 22 also faces outwardly of the refill 2 in an "U" shape, its two locks being arranged at its end and further an auxiliary projection 221.

With the cover 3 raised, the refill 2 will be fitted into the base 1. First, one should position refill 2 positioned on the base 1, taking care to arrange the first securing means 21 close to the first opening 12 and the second securing means 22 close to the second opening 13. In this way, the central wall 23 will be perpendicular to the axis between the hinge and the puller 5.

The first securing means 21 should be fitted into the first opening 12. Then, the user can press the refill 2 against the base 1. With this movement, the second securing means 22 is contracted due to its curved shape, its end being approximated to the refill 2. Thus, the second securing means 22 can be fitted into the second opening 13. With the presence of locks at its end, the second securing means 22 remains fixed to this opening 13. In this movement, the user can hear a characteristic sound of this type of fitting. In this way, the cover 3 can be lowered and the package is assembled.

Unlocking—Disassembling the refill out of the Package

With the cover 3 raised and with the aid of the auxiliary projection 221 located at the end of the second securing means 22, the user can press the second securing means 22 against the refill 2, so as to deform it and thus undo the interference between the locks and the second opening 13, and thus he can raise this side of the refill 2. Then, the refill 2 can be moved laterally, whereby the association between the first securing means 21 and the first opening 12 is undone, releasing the refill 2 from both sides. In this way, the refill 2 can be taken out of the base 1.

A preferred embodiment having been described, one should understand that the scope of the present invention embraces other possible variations, being limited only by the contents of the accompanying claims, which include the possible equivalents.

The invention claimed is:

1. A refillable container system for cosmetics, comprising:

a reusable container comprising a base and a cover connected to the base such that the cover is movable between a closed position and an open position;

the base comprising a bottom wall having an outer periphery and a side wall joined to the outer periphery and projecting upwardly therefrom such that the side wall and bottom wall collectively define a receptacle that is surrounded by the side wall;

the side wall defining a first opening and a second opening located opposite each other on opposite sides of the receptacle;

a refill having two trays that each define a cavity for containing a cosmetic, the two trays having auxiliary securing means that are associable with each other so as to join the two trays together to form the refill, the auxiliary securing means being tongue-and-groove type joints, the refill being configured to fit into the receptacle of the base, the refill comprising a first securing means and a second securing means, the first securing means comprising at least a first projection and the second securing means comprising at least a second projection located opposite from the first projection, the first and second projections being configured for respectively engaging the first opening and the second opening in the side wall of the base so as to secure the refill in the base;

the first projection extending outwardly and having an L-shaped configuration to enable the first projection to be engaged in the first opening as a first step of securing the refill in the base;

the second projection facing outwardly and having a curved edge and being flexible and configured to be deformed when, as a second step of securing the refill in the base, the refill is pressed against the base, so that the second projection allows the refill to seat in the base, whereupon the second projection engages the second opening and thereby secures the refill in the base;

wherein an outer end of the second projection is at a height relative to the cavity that is greater than a height of an outer end of the first projection relative to the cavity.

2. The refillable container system of claim 1, wherein the side wall further comprises a recess located above the second opening, and the second securing means further comprises an auxiliary projection at an extremity, the auxiliary projection and the recess being associable to each other.

* * * * *